United States Patent [19]

Pickett

[11] Patent Number: 4,835,499

[45] Date of Patent: May 30, 1989

[54] VOLTAGE TUNABLE BANDPASS FILTER

[75] Inventor: Michael N. Pickett, Phoenix, Ariz.

[73] Assignee: Motorola, Inc., Schaumburg, Ill.

[21] Appl. No.: 166,081

[22] Filed: Mar. 9, 1988

[51] Int. Cl.[4] ..... H01P 1/203

[52] U.S. Cl. ..... 333/205; 333/235

[58] Field of Search ..... 333/203–205, 333/235

[56] References Cited

U.S. PATENT DOCUMENTS

| | | | |
|---|---|---|---|
| 3,673,509 | 6/1972 | Cooper, Jr. | 333/204 |
| 3,889,214 | 6/1975 | Petitjean et al. | 333/203 |
| 4,577,170 | 3/1986 | Hayashi | 333/205 |
| 4,714,906 | 12/1987 | D'Albaret et al. | 333/235 X |

FOREIGN PATENT DOCUMENTS

| | | | |
|---|---|---|---|
| 220602 | 11/1985 | Japan | 333/204 |

OTHER PUBLICATIONS

Hunter, I. C. and Rhodes, J. D., "Electronically Tunable Microwave Bandpass Filter"; *IEEE Transaction on Microwave Theory & Techniques;* vol. MTT-30, No. 9; Sep. 1982; pp. 1354–1360.

*Primary Examiner*—Eugene R. Laroche
*Assistant Examiner*—Benny T. Lee
*Attorney, Agent, or Firm*—Jordan C. Powell

[57] ABSTRACT

A voltage tunable bandpass filter consisting of a plurality of parallel resonators electromagnetically coupled and having tuning diodes coupled to a first end. The resonators are DC isolated at a second or RF grounded end of each resonator. A voltage source reverse biases the tuning diodes from the second or less critical end of the resonators.

14 Claims, 1 Drawing Sheet

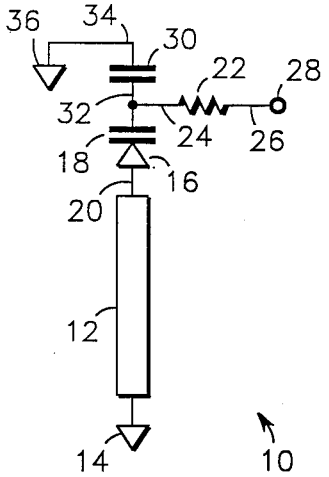
FIG. 1
—PRIOR ART—
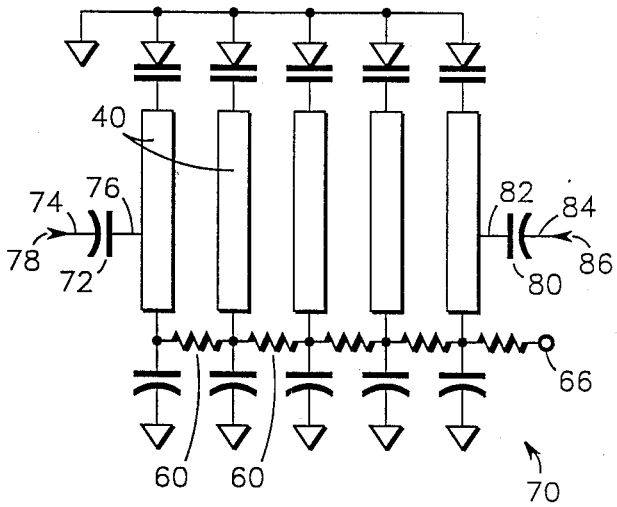
FIG. 3
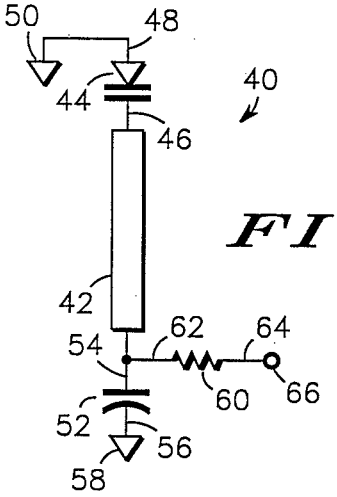
FIG. 2
FIG. 4
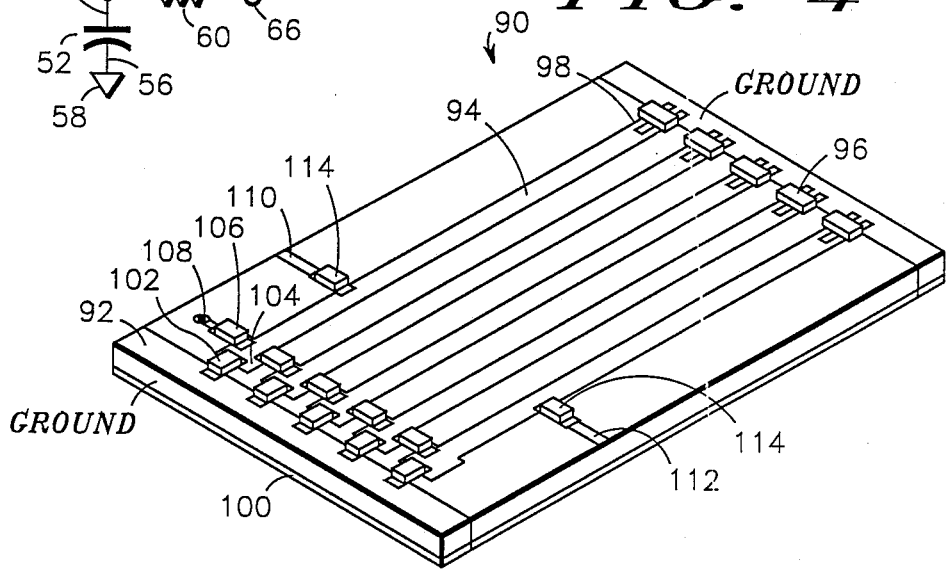

VOLTAGE TUNABLE BANDPASS FILTER

BACKGROUND OF THE INVENTION

The present invention pertains to a bandpass filter and more specifically to a voltage tunable combline filter.

Bandpass filters are filters which selectively pass signals having a certain frequency. Signals outside this frequency bandwidth are rejected so that they do not interfere with the desired signal.

In many applications, a variable range of signal frequencies is desired. The prior art meets this demand in a variety of ways. One such, is by using switchable fixed filters. This is a number of bandpass filters each tuned to a fixed frequency bandwidth. In order to pass different signals over a variety of frequencies, a number of fixed bandpass filters are used. The signals can then be switched between the filters to obtain the signal with the desired frequency.

The alternative to using a large number of filters is to produce a tunable bandpass filter. Some of these filters use tuning diodes for tuning. While this will allow a filter to selectively pass a wider range of frequencies, the components used in biasing the tuning diodes cause problems. They act as parasitic elements causing signal loss and stray capacitance which causes detuning of the filter. The biasing of filters using tuning diodes will be described in greater detail later in the application.

SUMMARY OF THE INVENTION

In view of the foregoing, it is therefore an object of the present invention to provide an improved tunable bandpass filter.

Another object of the present invention is to provide a tunable bandpass filter using tuning diodes.

A further object of the present invention is to reduce parasitic element effects associated with the discrete components used for biasing a tuning diode.

These and other objects of the present invention will become apparent to those skilled in the art upon consideration of the accompanying specification, claims and drawings.

The foregoing objects are achieved in the present invention wherein a bandpass filter has a plurality of distributed resonators. The distributed resonators are placed in parallel with an input and an output and each having a first end and a second end. The effective resonating frequencies of the distributed resonators can be altered by biasing tuning diodes coupled to the first end of each distributed resonator. An RF capacitor is coupled to the second end of each distributed resonator and goes to ground potential. A plurality of resistors are attached to the second end of the distributed resonators next to the radio frequency (RD) capacitors and opposite the grounded side. A voltage source is coupled to the resistors for reverse biasing the tuning diodes.

BRIEF DESCRIPTION OF THE DRAWINGS

FIG. 1 is a schematic drawing illustrating the tuning diode biasing circuit in a piror art resonator unit of a bandpass filter;

FIG. 2 is a schematic drawing illustrating the tuning diode biasing circuit of a resonator unit in an embodiment of the present invention;

FIG. 3 is a schematic diagram illustrating an embodiment of the present invention; and FIG. 4 is a isometric view illustrating an embodiment of the present invention.

DESCRIPTION OF THE PREFERRED EMBODIMENT

Referring now to the drawings, FIG. 1 is a schematic diagram illustrating the biasing circuitry in a prior art resonator unit of a tunable bandpass filter generally designated 10. Resonator unit 10 consists of a resonator 12 being a stripline material, having a first end and a second end. Said second end of resonator 12 goes to a ground potential terminal 14. A tuning diode 16 having a first terminal 20 and a second terminal 18 is coupled to resonator 12 via terminal 20. Tuning diode 16 is a back biased diode which, when biased causes a capacitance which alters the resonating frequency of resonator 12. A resistor 22 has a first terminal 24 coupled to terminal 18 of tuning diode 16, and a second terminal 26 coupled to a voltage source 28. An coupling capacitor 30 has a terminal 32 coupled to terminal 24 of resistor 22 and terminal 18 of tuning diode 16, and a terminal 34 which goes to ground 36. A plurality of resonator units 10 are placed in parallel to form a filter. A frequency dependent electromagnetic coupling is formed between resonators. Conventional bias circuitry requires components and associated mounting pads at the first or high impedance end the resonators. These components cause undesired parasitic tuning and coupling of the resonators, and may increase insertion loss of the filter. In addition, they make it difficult to achieve correct spacing between resonators units 10 due to their size.

FIG. 2 is a schematic diagram illustrating a resonator unit generally designated 40 embodying the present invention. Resonator unit 40 comprises a resonator 42 having a first end and a second end and which may be microstrip or stripline. A tuning diode 44 having a first terminal 46 and a second terminal 48 is coupled to resonator 42 via terminal 46. Terminal 48 of tuning diode 44 is coupled to a ground potential 50. A coupling capacitor 52 having a first terminal 54 and a second terminal 56 is coupled to resonator 42 via terminal 54. Terminal 56 of coupling capacitor 52 is coupled to a ground potential 58. A resistor 60 having a first terminal 62 and a second terminal 64 is coupled to resonator 42 via terminal 62. Terminal 64 of resistor 60 is coupled to a voltage source 66.

FIG. 3 is a schematic diagram illustrating a bandpass filter generally designated 70 embodying the present invention. A plurality of resonator units 40 as illustrated in FIG. 2, are coupled by electromagnetic means well-known to those skilled in the art. In this embodiment, five resonator units 40 are used to form the bandpass filter 70. Resistor 60 of each resonator unit 40 are coupled in series and coupled to a voltage source 66. A coupling capacitor 72 having terminals 74 and 76 is coupled to a first resonator unit 40 between the first end and the second end via terminal 76. Terminal 74 of capacitor 72 is connected to an input port 78. A coupling capacitor 80 having terminals 82 and 84 is coupled to the resonator unit 40 on the end of filter 70 opposite resonator unit 40 having the input port 78. Terminal 84 of coupling capacitor 80 is coupled to output port 86.

FIG. 4 is an isometric view illustrating an embodiment of the present invention. In this embodiment, a bandpass filter generally designated 90 is located on a printed wiring board 92. In this embodiment, resonators 94 are microstrip. Tuning diodes 96 are coupled to a first end 96 of distributed resonator 94 and coupled to ground plane 100. Coupling capacitors 104 are connected to a second end 104 of resonator 94 and connected to ground plane 100. Resistors 106 in series are coupled to voltage source 108 and connected to end 104 of resonators 94. Resistors 106 are connected to resonators 94 just above capacitors 102 on the side opposite their attachment to the ground plane 100. Resonators 94 form a frequency dependent conductive path with an input attached to the resonator on one side and an output attached to the resonator on the opposite side. Coupling capacitors 114 couple input port 110 to resonator 94 and output port 122 to resonators 94.

Tuning diodes 96 must now be reverse biased in order to tune resonators 94. Voltage source 108 produces a voltage across resistor 106. Coupling capacitors 102 prevent this voltage from going to ground. Further, since the tuning diodes are reverse biased, substantially no current is produced. Thus, each of tuning diodes 96 is biased substantially equally. While coupling capacitor 102 prevents direct current (DC) voltage from going to ground, it allows the RF voltage to go to ground. Thus, resonator end 104 as it approaches capacitor 102 approaches zero voltage while resonator end 98 has the higher RF voltage and thus is the more critical end. The biasing of the tuning diodes 96 in this manner, with only one component at the critical end, and the other components at the less critical end reduce parasitic elements at the critical end of the resonator.

Thus, a tunable bandpass filter having reduced signal losses has been achieved. In the prior art, resistors at the critical end cause parasitic loss in signal. In the present invention, with resistors at the less critical end, there is substantially no signal loss since the voltage at the less critical end of resonators 94 approaches zero. Also, tuning range of the resonators is greatly improved since stray capacitance is reduced by placing only one component at the critical end and parasitic coupling is reduced between resonators producing a filter whose response is closer to ideal. Further, the physical construction of the present invention is simplified since the components need not be fitted in the same small area. The resonators, due to this lack of congestion, can be spaced with greater accuracy. Also, since the resonators can be microstrip, a much simpler and less expensive filter can be obtained.

The filter embodying the present invention covers a band range of approximately 225 $MH_z$ to 400 $MH_z$ with bandwidth of approximately 30 $MH_z$. In the embodiment having microstrip resonators when a matched set of tuning diodes are used, no alignment of the filter is required. The coupling capacitors used in this invention DC isolate the resonator, while allowing RF to pass. Also, by CD isolating each resonator with low loss capacitors at the short circuit or less critical end the resonators, the tuning diode bias circuitry is simplified, and stray capacitance and inductance associated with tuning diode bias networks is substantially eliminated. The loss due to Q reduction caused by the bias circuitry is primarily determined by the capacitors at the second end of the resonators. Low loss porcelain capacitors may be used resulting in minimal loss. Also, a grounded cover may be installed over the filter to improve out of band rejection.

Having thus described the invention, it will be apparent to those skilled in the art that various modifications can be made within the spirit and scope of the present invention.

I claim:

1. A method of biasing a voltage tunable bandpass filter to decrease distortion and eliminate DC parasitics, said method comprising the steps of:

coupling each one of a plurality of varactors to a first end of an associated one of a plurality of resonators;

coupling a first end of each of a plurality of capacitors to a second end of the associated one of said plurality of resonators;

coupling a second end of each one of said plurality of capacitors to a ground potential; and coupling each one of a plurality of resistors between adjacent resonators, said plurality of resistors coupled to said second end of said plurality of resonators adjacent to said first end of said plurality of capacitors, said plurality of resistors coupled to a voltage source.

2. A voltage tunable bandpass filter which incorporates a unique biasing scheme to eliminate parasitics caused by biasing, said filter comprising:

at least one resonator means for creating a resonating frequency, each one of said at least one resonator means having a first port and a second port;

at least one tuning means to tuning said resonator means, each of said tuning means including a first port electrically coupled to an electrical ground, and a second port electrically coupled to said first port of an associated one of said resonator means; and at least one biasing means for reverse biasing said tuning means, each of said biasing means including a first port electrically coupled to said second port of an associated one of said resonator means, and a second port electrically coupled to said ground.

3. A voltage tunable bandpass filter according to claim 2 wherein said tuning means comprises a varactor capacitor.

4. A voltage tunable bandpass filter according to claim 2 wherein said biasing means comprises:

at least one capacitor means for direct current isolating said resonator means and for radio frequency grounding said resonator means, each of said capacitor means including a first port electrically coupled to said second port of an associated one of said resonator means, and a second port electrically coupled to said ground; and at least one resistor means for biasing said biasing means, each of said resistor means including a first port electrically coupled to said first port of the associated one of said capacitor means, and a second port electrically coupled to a voltage source.

5. A voltage tunable bandpass filter according to claim 2 wherein said filter comprises a microstrip filter.

6. A voltage tunable bandpass filter according to claim 2 wherein said at least one resonator means comprises a plurality of resonator means for filtering a radio frequency, said plurality of resonator means electrically coupled in parallel to each other.

7. A voltage tunable bandpass filter according to claim 6 wherein said filter further comprises:

first coupling means for coupling said filter to an input, said coupling means including a first port electrically coupled to a first of said plurality of resonator means, and a second port coupled to said input; and second coupling means for coupling said filter to an output, said coupling means including a first port electrically coupled to a last of said plurality of resonator means, and a second port electrically coupled to said output.

8. A voltage tunable bandpass filter according to claim 7 wherein said first and second coupling means each comprise capacitors.

9. A voltage tunable bandpass filter which incorporates a unique biasing scheme to eliminate parasitics caused by biasing, said filter comprising:

at least one resonator means for creating a resonating frequency, each of said at least one resonator means having a first port and a second port;

at least one tuning means for tuning said resonator means, each of said tuning means including a first port electrically coupled to an electrical ground, and a second port electrically coupled to said first port of an associated one of said resonator means;

at least one capacitor means for direct current isolating said resonator means and for radio frequency grounding and resonator means, each of said capacitor means including a first port electrically coupled to said second port of the associated one of said resonator means, and a second port electrically coupled to said ground; and at least one resistor means for biasing said tuning means, each of said resistor means including a first port electrically coupled to said first port of the associated one of said capacitor means, and a second port electrically coupled to a voltage source.

10. A voltage tunable bandpass filter according to claim 9 wherein said tuning means comprises a varactor capacitor.

11. A voltage tunable bandpass filter according to claim 9 wherein said filter comprises a microstrip filter.

12. A voltage tunable bandpass filter according to claim 9 wherein said at least one resonator means comprises a plurality of resonator means for filtering a radio frequency, said plurality of resonator means electrically coupled in parallel to each other.

13. A voltage tunable bandpass filter according to claim 12 wherein said filter further comprises:

first coupling means for coupling said filter to an input, said coupling means including a first port electrically coupled to a first of said plurality of resonator means, and a second port coupled to said input; and second coupling means for coupling said filter to an output, said coupling means including a first port electrically coupled to a last of said plurality of resonator means, and a second port electrically coupled to said output.

14. A voltage tunable bandpass filter according to claim 13 wherein said first and second coupling means each comprise capacitors.

* * * * *